US008322727B2

(12) United States Patent
Tigue et al.

(10) Patent No.: US 8,322,727 B2
(45) Date of Patent: Dec. 4, 2012

(54) QUICK CHANGE SYSTEM FOR A MACHINE

(75) Inventors: Joseph D. Tigue, Peoria, IL (US); Christopher W. Preuss, Plainfield, IL (US)

(73) Assignee: Caterpillar Inc., Peoria, IL (US)

( * ) Notice: Subject to any disclaimer, the term of this patent is extended or adjusted under 35 U.S.C. 154(b) by 1035 days.

(21) Appl. No.: 12/327,123

(22) Filed: Dec. 3, 2008

(65) Prior Publication Data

US 2010/0137117 A1 Jun. 3, 2010

(51) Int. Cl.
*B23B 31/113* (2006.01)

(52) U.S. Cl. ..... 279/93; 279/9.1; 403/349

(58) Field of Classification Search ..... 279/9.1, 279/89, 93, 94, 104, 143; 403/349; *B23B 31/113; B25G 3/16*

See application file for complete search history.

(56) References Cited

U.S. PATENT DOCUMENTS

| | | | | |
|---|---|---|---|---|
| 2,732,751 | A * | 1/1956 | Heidecke et al. | 396/530 |
| 3,170,975 | A | 2/1965 | Bauer et al. | |
| 3,679,220 | A * | 7/1972 | Reeves | 279/89 |
| 3,998,467 | A | 12/1976 | Petkovich | |
| 4,328,975 | A * | 5/1982 | Heguy et al. | 279/91 |
| 4,844,427 | A | 7/1989 | Pedersen | |
| 4,911,632 | A | 3/1990 | Mansfield | |
| 5,797,605 | A | 8/1998 | Gross et al. | |
| 6,701,629 | B2 * | 3/2004 | Krondorfer et al. | 30/390 |
| 7,077,735 | B2 * | 7/2006 | Krondorfer et al. | 451/359 |
| 7,584,971 | B2 * | 9/2009 | Weller | 279/93 |
| 7,866,894 | B2 * | 1/2011 | Hewitt | 384/556 |
| 2012/0161404 | A1 * | 6/2012 | Ronald et al. | 279/9.1 |

FOREIGN PATENT DOCUMENTS

| | | | |
|---|---|---|---|
| DE | 3130447 | A1 * | 2/1983 |
| EP | 105387 | A1 * | 4/1984 |
| EP | 729801 | A1 * | 9/1996 |
| WO | WO 9322091 | A1 * | 11/1993 |

OTHER PUBLICATIONS

Gleason Corporation, The Gleason Works Workholding Solution On-line Catalog, www.gleason.com, Aug. 2006.

* cited by examiner

*Primary Examiner* — Eric A Gates
(74) *Attorney, Agent, or Firm* — Janda M. Carter

(57) ABSTRACT

A quick change system for quench press tooling is disclosed. The system including an upper adapter subassembly, an inner bottom adapter, and an outer bottom adapter, the upper adapter subassembly configured for attachment to a machine and the bottom adapters configured for mechanical attachment to the tooling of the machine. The upper adapter assembly further including an inner top adapter having a plurality of notches radially along the outer diameter of the inner top adapter, an inner collar having a plurality of radially inwardly extending tabs at top and bottom ends of the inner collar, a ring shaped holding plate having a series of bolt holes, an outer top adapter in communication with the holding plate, having a notched outwardly extending flange lip, and an outer collar having an outwardly extending lip at a top end and a sidewall extending perpendicularly downward.

14 Claims, 5 Drawing Sheets

QUICK CHANGE SYSTEM FOR A MACHINE

TECHNICAL FIELD

This disclosure is related to changeover tooling system generally, and more specifically to a quick change system for machine tooling.

BACKGROUND

It is common practice, for example in the metallurgical art, to heat treat and then cool or quench a workpiece or part for one or more of a variety of reasons. This heat treatment and cooling process may be used to develop desired microstructure and mechanical properties in the metal part, with the typical desire to avoid physical defects such as cracking, distortion and residual stresses which impact such characteristics as machinability during manufacture, assembly, or repair, and fatigue life of the part.

Quench pressing involves quenching a workpiece by restraining it in dies while controlling the quenchant flow to different parts of the surface until the part is fully cooled to a predetermined temperature. This heat treat related process is widely used for precision parts that need exact dimensions after quenching.

Although quenched workpieces are typically under closely controlled conditions while in a press, very often the workpiece must be transferred manually from the reheat furnace to the quench press, and removed from it. Further, the quench press tooling must be changed, typically several times in a single shift. This may involve reaching into a live press, excessive bending and reaching to tighten or loosen bolts, and significant time lost to align boltholes.

The present disclosure addresses those issues.

SUMMARY OF THE INVENTION

A quick change system for a machine tool is disclosed. The system including an upper adapter subassembly, an inner bottom adapter, and an outer bottom adapter, the upper adapter subassembly configured for attachment to a machine and the bottom adapters configured for mechanical attachment to the tooling of the machine. The upper adapter assembly further including an inner top adapter having a plurality of notches radially along the outer diameter of the inner top adapter, an inner collar having a plurality of radially inwardly extending tabs at top and bottom ends of the inner collar, a ring shaped holding plate having a series of bolt holes, an outer top adapter in communication with the holding plate, having a notched outwardly extending flange lip, and an outer collar having an outwardly extending lip at a top end and a sidewall extending perpendicularly downward. The inner bottom adapter having a plurality of radially outwardly extending notches at a top end and the outer bottom adapter in engagement communication with the inner bottom adapter.

Further, a method for use of the quick change system of the present disclosure.

BRIEF DESCRIPTION OF THE DRAWINGS

The foregoing summary, as well as the following detailed description of embodiments of the disclosure, will be better understood when read in conjunction with the appended drawings. For the purpose of illustrating the disclosure, there are certain embodiments shown. It should be understood, however, that the disclosure is not limited to the precise arrangements and instrumentalities shown. In the drawings.

DETAILED DESCRIPTION

Figure 1:
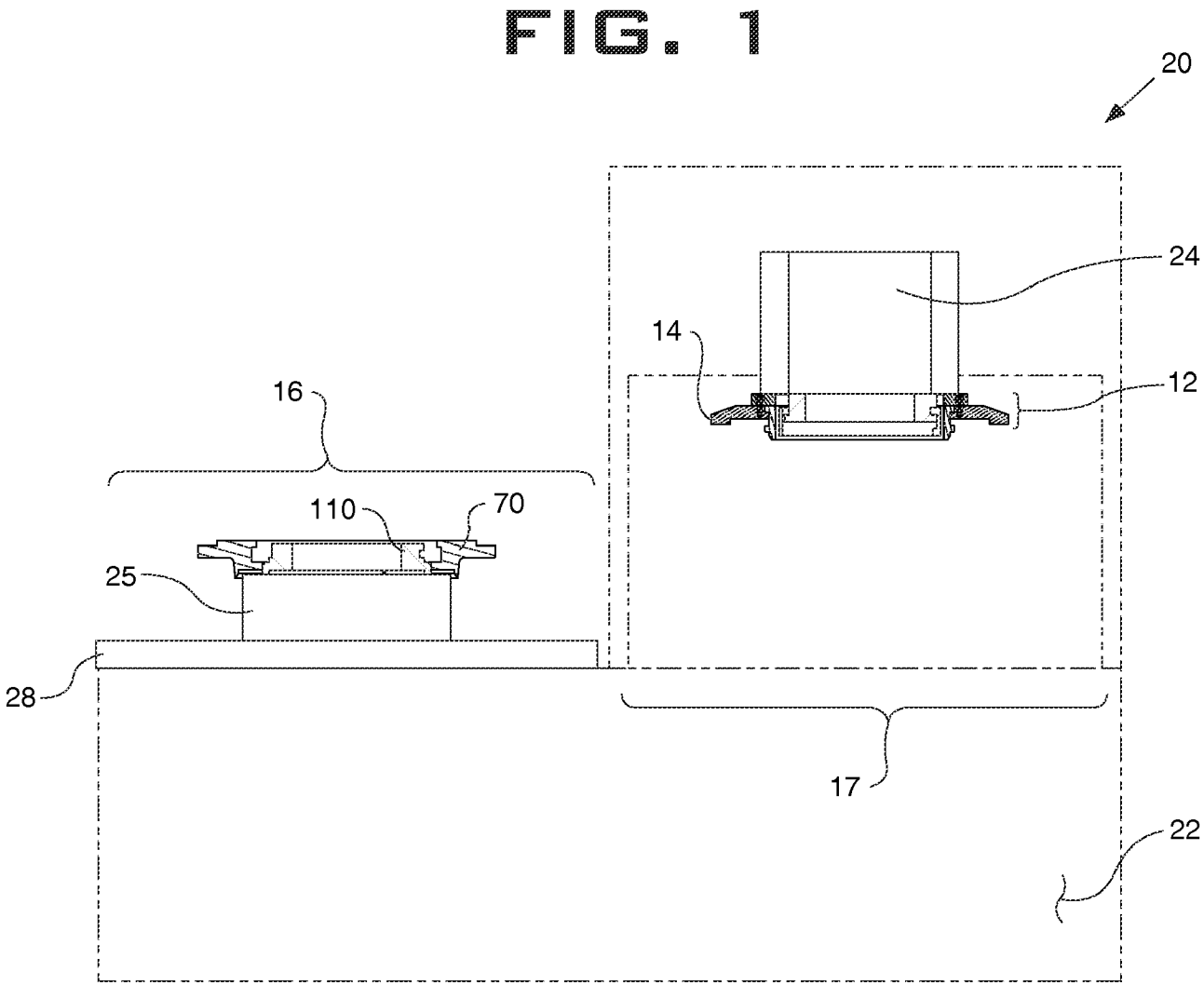
FIG. 1 is a side view of a quench press machine of the present disclosure.

Certain terminology is used in the following description for convenience only and is not limiting. The words "right," "left," "upper," and "lower" designate directions in the drawings to which reference is made. The terminology includes the words above specifically mentioned, derivatives thereof, and words of similar import. Referring now to the drawings, wherein like numerals indicate like elements throughout, and particularly as illustrated in FIG. 1, the quench press machine 20 includes basically a rigid frame structure 22 upon which may be mounted hydraulic cylinder operated lower and upper ram assemblies (generally shown at 24). The quench press machine 20 may support a ram 24 for vertical movement of the upper die assembly by means of a hydraulically actuated piston in a cylinder secured to the frame, or any other vertical movement means, as would be understood by one skilled in the art. The press machine 20 may include a table or support tray 28 mounted for horizontal translatory movement between a forward, gear loading and unloading position 16 as shown in FIG. 1, and a rear operative working position 17 coaxially aligned beneath the upper ram assembly 24. The support tray 28 may slide out horizontally on rods to carry the workpiece 10 from a loading position at the front 16 to a working position 17 inside the machine 20 between various operations during a shift.

The quench press machine 20 may be manually or automatically operated, cycling a workpiece 10 to be quenched into a position coaxially beneath the ram assembly 24, where the upper ram may be then lowered under hydraulic pressure or other suitable means, to a closed press position.

Quench tooling, indicated generally at 25, having an upper surface is illustrated. The tooling 25 is adaptable for use with the quench press machine 20, illustrated in FIG. 1, being attached to the support tray 28 by conventional means (not shown) in a known manner. When an operator wishes to change the tooling, the lower surface of bottom or lower adapters 70, 110 of the quick change adapter system of the present disclosure, is disposed against the upper surface of the support tray 28. As will be explained in detail below, once the tooling is placed on the support tray 28, the lower bottom adapters 70, 110 may be attached to the tooling 25. Traditionally, bolts may be used to join the tooling 25 to an adapter. Any mechanical means of attachment may be used, as would be understood by one skilled in the art.

The quench tooling 25 is placed in communication with the workpiece 10 to provide quenching and cooling inside the machine 20. The tooling 25 must be attached to the ram 24 of the machine 20, which is inside the machine 20. The tooling 25 traditionally must be aligned with, and bolted to the ram 24 and upper die. The tooling 25 may be of various sizes, according to the size of the workpiece 10 being processed during an operational shift, and therefore may be required to be changed several times during a shift. Bolting the tooling 25 to the adapter while the adapter is on the ram of the press was difficult as the operator was typically blind sighted in regard to the location of the boltholes. Further, it is awkward and difficult for an operator to access the tooling and ram. The tooling was attached to the ram 24 of the machine 20 while the assembly was in the working position 17 with the ram 24 retracted, making it awkward and difficult for an operator to access the tooling and ram 24. Notably, the bottom adapters 70, 110 of the present disclosure will seamlessly interface with current ram assemblies 24.

The quick change adapter system of the current disclosure provides for only a top portion subassembly stay in the machine. During initial set up, the pieces that will stay in the machine 20 are the top portion of the quick change adapter, bolted to the ram itself. Bolting attachment for all pieces that may change regularly during a shift (for example the tooling 25 and the bottom adapters 70, 110) occur completely outside of the machine, in the easily accessible front loading area 16. Once the tooling 25 and bottom adapters 70, 110 are inside the press, the collars are used to join them to the upper adapter subassembly and ram press 24. There is no need to adjust the tooling to align the boltholes, as is described in detail below. The present disclosure provides a means for ease of access for routine operational changeovers.

The upper subassembly 12 of the adapter includes a mounting surface extending outwardly therefrom. The mounting surface is shaped in a conventional manner to facilitate the attachment of the upper adapter to the ram 24 by conventional means (not shown) cooperating with the ram 24 in a known manner. When so attached, the upper surface of the upper adapter may be disposed flat against the lower surface of the ram 24. As will be explained in detail below, once the upper adapter subassembly 12 is attached to the ram 24 in a proper position within the machine 20, it does not need to be removed therefrom during use.

Figure 2:
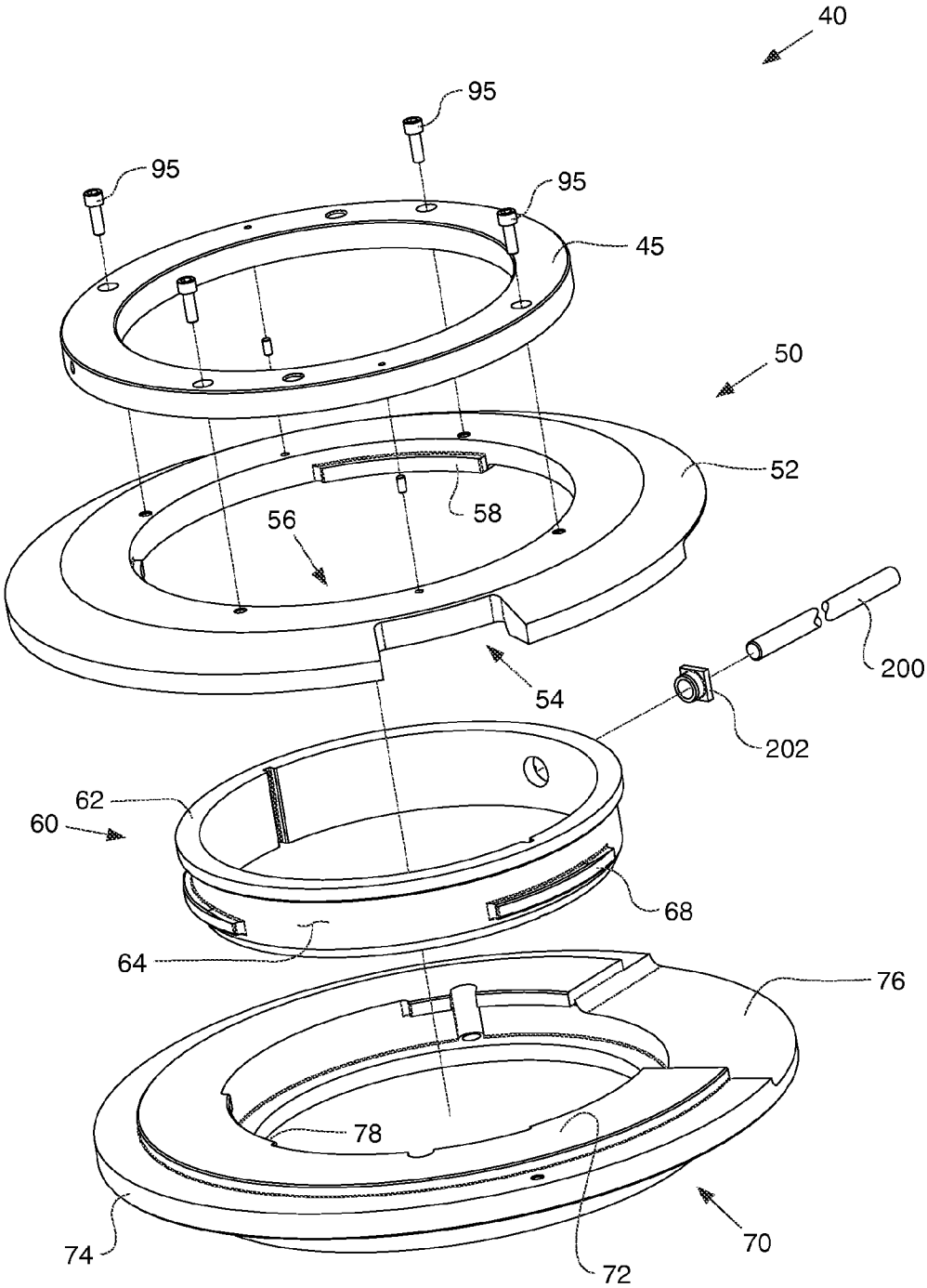
FIG. 2 is an exploded view of the inner adapter system of the present disclosure.

Turning now to FIG. 2, with a focus on the quick change system of the present disclosure, the components of the outer adapter assembly 40 are shown. The outer adapter assembly 40 components comprise a majority of the upper adapter subassembly 12, which is configured for attachment to the upper press die assembly and ram 24. The outer adapter assembly 40 includes a holding plate 45 having a series of boltholes 25. The holding plate 45 may be circular, ring shaped, or any other geometry suitable for use in the machine 20. An outer top adapter 50 is in communication with the holding plate 45, through the series of boltholes axially aligned with those in the holding plate 45. The primary purpose of the plate 45 is to hold the outer collar subassembly to the outer top adapter 50. The holding plate 45 may also provide the surface that contacts the outer ram 24. Bolts 95 connect the upper outer adapter subassembly 12 to the outer ram 24.

The outer top adapter 50 may have an outer peripheral flange lip 52, and one or more notches 54. Additionally, the outer top adapter 50 may have a central opening 56, a plurality of radially inwardly extending L-shaped protrusions 58 attached to a bottom end of the outer top adapter 50 for engagement with the outer collar 60.

An outer collar 60 having a small radially outwardly extending lip 62 at a top end and a sidewall 64 extending perpendicularly downward, is shown in FIG. 2. The outer collar 60 generally has an outer diameter smaller than the outer top adapter 50, and when assembled in the upper adapter subassembly 12, the lip 62 abuts and rotationally travels along the inner diameter of the outer top adapter 50. The outer collar 60 had a plurality of outwardly extending tabs 68 along the sidewall 64. These tabs 68 engage the outer bottom adapter 70 during the rotation of lever 200 (described below).

An outer bottom adapter 70 is another component of the outer adapter assembly 40. The outer bottom adapter 70 and an inner bottom adapter 110 are separately and individually assembled to the inner and outer components of the tooling 25. The outer 70 and inner 110 bottom adapters join with the upper adapter subassembly 12, and are sized for attachment to various sized existing press tooling 25. The outer bottom adapter 70 may have a stepped top surface 72 and outer peripheral flange lip 74 for mating to the outer top adapter 50. The bottom adapters 70, 110 may be boltingly attached to the tooling 25 on the table 28, when in the easily accessible front loading area 16 position. If tweaking of the alignment is needed, it can be done when the operator's arms are out of the machine 20.

The outer adapter assembly 40 further includes a lever 200 (described in detail below), a fitting 202 for engagement of the lever 200 to the locking assembly (also described below), and a plurality of attachment bolts 95. The raised stepped engagement top surface 72 of the outer bottom adapter 70 may not be annularly continual, with an annularly extending lower flat surface 76, providing a travel path and surface for the lever 200.

Figure 3:
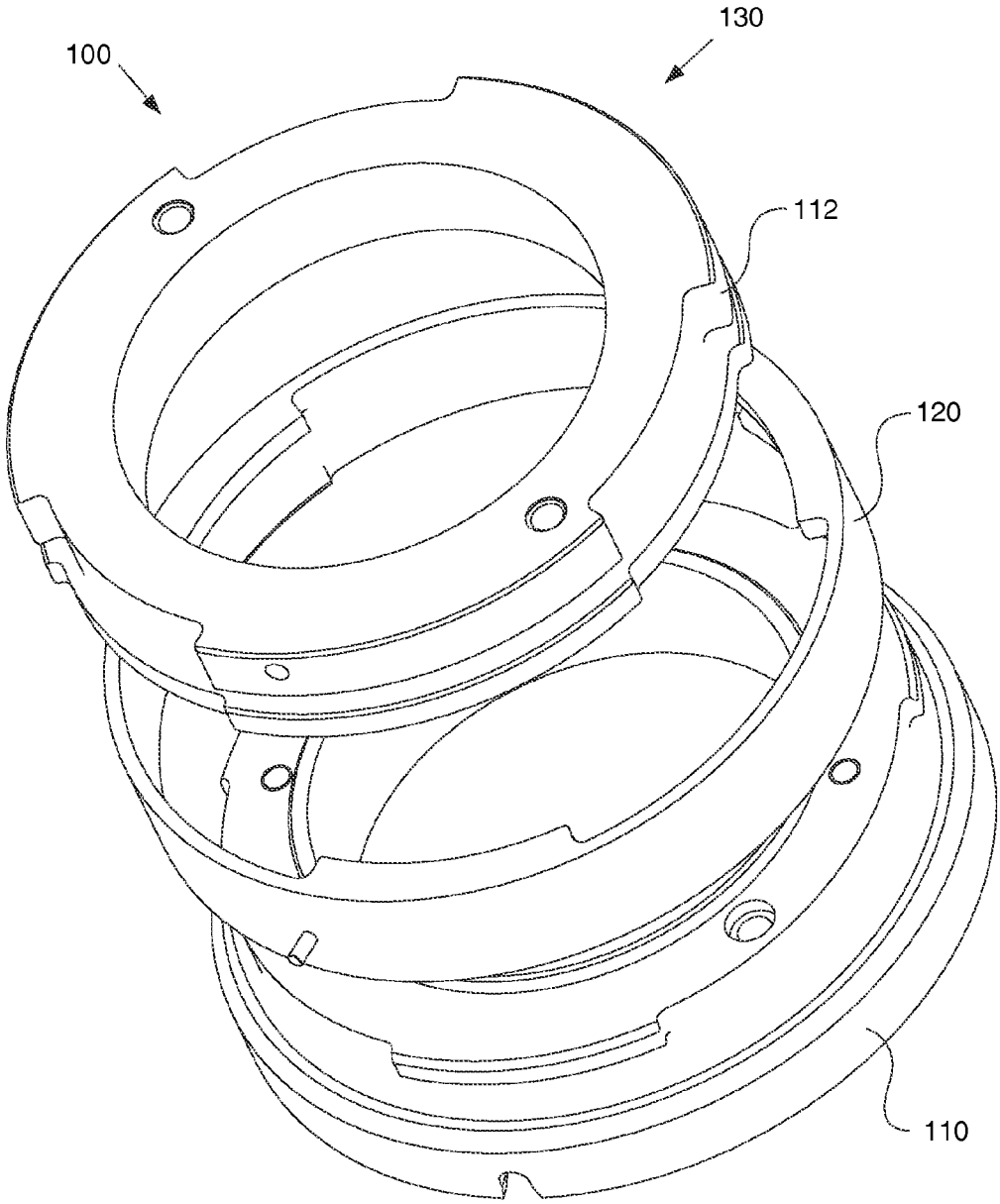
FIG. 3 is an exploded view of the outer adapter system of the present disclosure.
Figure 4:
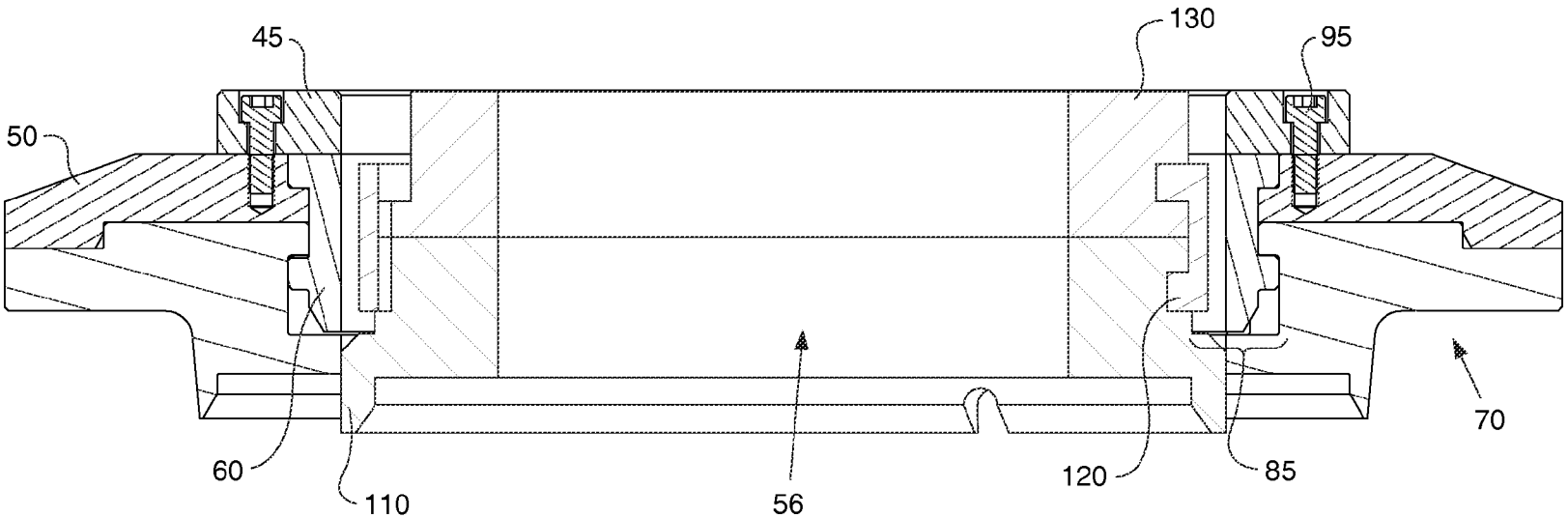
FIG. 4 is a cross sectional view of the connected upper and lower adapter subassemblies of the present disclosure.
Figure 5:
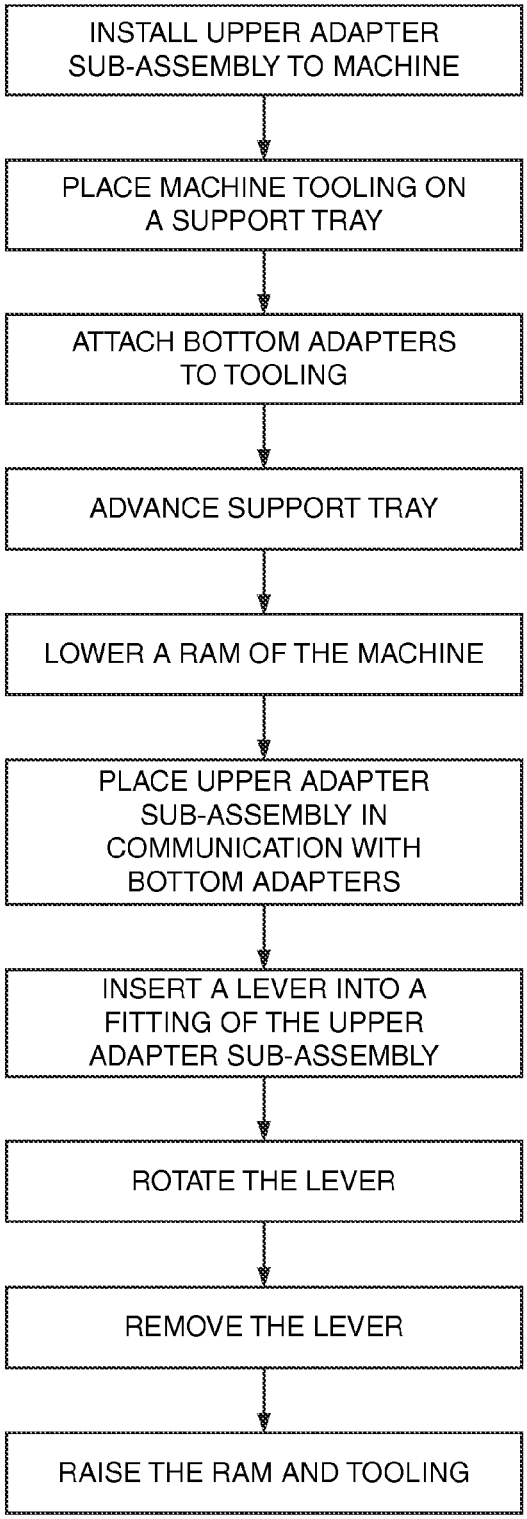
FIG. 5 is a flow chart showing the method of use for a quick change adapter system of the present disclosure.

Referring to FIG. 3, there is illustrated a diagrammatic representation of an inner adapter assembly 100 of the present disclosure including an inner bottom adapter 110, an inner collar 120, and an inner top adapter 130. The inner bottom adapter 110 may have a plurality of radially outwardly extending notches 112 at a top end, and an outer diameter that is larger at a bottom end for abutting communication with the tooling 25. The cross-sectional mating area 85 at the inner diameter of the outer bottom adapter 70 at a top end, and the outer diameter top end of the inner bottom adapter 110 generally forming a U-shaped channel configured to receive the downwardly extending sidewall 64 of the outer collar 60, and the inner collar 120.

An inner top adapter 130 may have a plurality of notches radially along the outer diameter of the inner top adapter 130 and be in attached to the ram 24. The inner collar 120 may have a plurality of radially inwardly extending tabs at top and bottom ends of the inner collar 120, configured to engage with the inner top adapter 130 and the inner bottom adapter 110. Further, a portion of the inner top adapter 130 is configured for disposal within the inner diameter of the inner collar 120 and is rotatably there between a first position, wherein the tabs are aligned with the protrusions to retain the inner bottom adapter 110 within the inner collar, and a second position, wherein the tabs are not aligned with the protrusions to permit removal of the inner bottom adapter 110 from the inner collar 120, which allows the upper adapter subassembly and the inner bottom adapter 110 to be disengaged. As is shown and should be understood, operation occurs with engagement and disengagement of the inner bottom adapter with the collar 120. The upper inner adapter remains with the collar in the machine 20.

A lever 200 may be inserted into fitting 202 on the outer collar 60 and used to rotate both the inner and outer collar into locking engagement via two tabs that join the inner 120 and outer collars 60. The collars rotate simultaneously. These tabs allow for independent vertical movement of inner and outer rams 24. On some machines, the inner and outer rams can move independently in a limited range. The design of these collars 120, 60 allows for the limited motion in the vertical direction. Further, the outer collar 60 rotates to engage the outer top adapter 50 to the outer bottom adapter 70. The inner collar 120 rotates to engage and join the inner top adapter 130 to the inner bottom adapter 110. The tabs on the outer collar 60 rotate as the lever 200 translates to diametrically align with and surround the tab on the outer top adapter 50 and an inwardly extending short lip 78 on the outer bottom adapter 70. Similar engagement occurs for the inner collar 120 with the inner top 130 and inner bottom 110 adapters. After the lever 200 is rotated the complete distance along the radially extending lower flat surface 76, a locked effect is created with the upper adapter subassembly 12 and the bottom adapters 70, 110. The lever 200 may then be removed.

The operator may then actuate the ram and retract it away from the support table 28. Once the ram 24 is in full open position, then table 28 may extend back out to the easily accessible front loading area 16 and the operator may perform the normal functions of removing the hot workpiece 10 from the oven, placing the piece 10 on the support table tray 28, running the table 28 into the machine 20, lowering the ram 24 and placing the tooling 25 and the workpiece 10 in communication, and performing the quench.

A shroud (not shown) may be attached to the press, functioning as a door, and closed during quenching. As is understood, a shroud may be in the form of thick metal cylindrical geometry for the purpose of maintaining the quenching fluid inside the press 20. The shroud ultimately forms a fluid tight chamber enveloping the workpiece 10 or gear to be quenched. The workpiece 10 may then be flooded with oil, water, or other suitable quenching fluid. This quench process may continue at required temperatures and quench times to achieve the desired cooling of the workpiece 10. After quenching the workpiece 10, the circulation is stopped, the dies are opened by raising the ram and the workpiece 10 may be unloaded.

Industrial Applicability

The disclosed quick change system finds potential application in any die system where it is desirous to quickly change tooling for various workpiece sizes. One skilled in the art will recognize that the disclosed system could be utilized in relation to other machines that may or may not be associated with quenching.

It will be appreciated that the foregoing description provides examples of a novel quick change system for quench press tooling. However, it is contemplated that other implementations of the disclosure may differ in detail from the foregoing examples, as would occur to those skilled in the art. In the figures, a simple, two-die quench press is illustrated, but it is understood that the disclosure can be used with more complicated and sophisticated sets ad assemblies, or with other machines besides quench presses. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely, unless otherwise indicated.

Recitation of ranges of values or dimensions herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. Accordingly, this disclosure includes all modifications and equivalents of subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A quick change system for a machine tool comprising:

an upper adapter subassembly, an inner bottom adapter, and an outer bottom adapter, the upper adapter subassembly configured for attachment to a machine and the bottom adapters configured for mechanical attachment to the tooling of the machine;

the upper adapter subassembly further comprising an inner top adapter having a plurality of notches radially along the outer diameter of the inner top adapter, an inner collar having a plurality of radially inwardly extending tabs at top and bottom ends of the inner collar, a ring shaped holding plate having a series of bolt holes, an outer top adapter in communication with the holding plate, having a notched outwardly extending flange lip, and an outer collar having an outwardly extending lip at a top end, a sidewall extending perpendicularly downward, and a plurality of outwardly extending tabs along the sidewall;

the inner bottom adapter having a plurality of radially outwardly extending notches at a top end; and the outer bottom adapter in engagement communication with the inner bottom adapter.

2. The quick change system of claim 1, wherein the holding plate is connected to the outer top adapter.

3. The quick change system of claim 1, wherein the top side of the outer bottom adapter includes a stepped raised annular engagement surface, providing a travel path for a rotation engagement lever.

4. The quick change system of claim 1, wherein the stepped raised annular engagement surface is not continual.

5. The quick change system of claim 1, wherein the non continual portion of the stepped raised annular engagement surface, is an annually lower flat surface providing a travel path for the rotation engagement lever.

6. The quick change system of claim 1, wherein the sidewall of the outer collar is sized to fit within the inner diameter of the outer bottom adapter and configured for insertion into the outer bottom adapter, defining a central opening.

7. The quick change system of claim 1, wherein the plurality of outwardly extending tabs of the outer collar are configured for engagement contact with a plurality of radially inwardly extending L-shaped protrusions of the outer top adapter.

8. The quick-change system of claim 1, wherein a plurality of radially inwardly extending tabs at top and bottom ends of the inner collar are configured to engage with the inner top adapter and the inner bottom adapter.

9. The quick-change system of claim 1, wherein the outer top adapter has a plurality of radially inwardly extending L-shaped protrusions attached to a bottom end of the outer top adapter for engagement with the outer collar.

10. The quick change system of claim 1, wherein the inner top adapter is configured for disposal within the inner collar and rotatably therein between a first position, wherein tabs on the outer collar are aligned with protrusions on the outer top adaptor to retain the inner bottom adapter within the inner collar, and a second position, wherein the tabs are not aligned with the protrusions to permit removal of the inner bottom adapter from the inner collar.

11. The quick change system of claim 1, wherein the outer and inner bottom adapters are sized for attachment to existing tooling.

12. The quick change system of claim 1, wherein the outer diameters of the outer and inner bottom adapters at the bottom ends are configured for abutment to the tooling.

13. The quick change system of claim 1, wherein a lever rotationally engages along a radially extending lower flat surface of the outer bottom adapter, creating a locked effect between the upper adapter subassembly and the bottom adapters.

14. The quick change system of claim 1, wherein the system further includes a shroud door.

* * * * *